US007375270B2

(12) United States Patent
Abernethy

(10) Patent No.: US 7,375,270 B2
(45) Date of Patent: May 20, 2008

(54) TRANSVERSE WHISTLE FLUTE AND METHOD OF PLAYING

(76) Inventor: Daniel L Abernethy, 7320 20th Ave. NE., Seattle, WA (US) 98115

( * ) Notice: Subject to any disclaimer, the term of this patent is extended or adjusted under 35 U.S.C. 154(b) by 36 days.

(21) Appl. No.: 11/039,752

(22) Filed: Jan. 19, 2005

(65) Prior Publication Data

US 2006/0156897 A1 Jul. 20, 2006

Related U.S. Application Data

(60) Provisional application No. 60/554,293, filed on Mar. 18, 2004.

(51) Int. Cl.
*G10D 9/04* (2006.01)

(52) U.S. Cl. ..... 84/380 R; 84/384

(58) Field of Classification Search ..... 84/380 R, 84/384; D17/10, 13
See application file for complete search history.

(56) References Cited

U.S. PATENT DOCUMENTS 3,011,382 A * 12/1961 Kim ..... 84/384
4,104,948 A * 8/1978 Young ..... 84/380 C
4,499,810 A 2/1985 Ferron
4,515,060 A 5/1985 Ferron
4,714,000 A * 12/1987 Braun ..... 84/384
4,714,001 A 12/1987 Kergomard et al.
5,309,806 A 5/1994 Stavash
6,660,919 B2 12/2003 Lim

* cited by examiner

*Primary Examiner*—Lincoln Donovan
*Assistant Examiner*—Jianchun Qin
(74) *Attorney, Agent, or Firm*—Polly L. Oliver

(57) ABSTRACT

A musical instrument similar to the traditional flute but easier to play and master has been designed as an introductory flute. The whistle flute can also be used by those who have had difficulty with traditional flute embouchure and/or for recreation, education, music therapy, and stage performance. With greater range, easier handling, and simpler fingering, the whistle flute will augment or replace the recorder style flutes now used in elementary schools. In addition, the whistle flute's inner whistle design could be utilized as a training or transitional mouthpiece for any type of transverse flute.

19 Claims, 2 Drawing Sheets

TRANSVERSE WHISTLE FLUTE AND METHOD OF PLAYING

This application claims priority under 35 U.S.C. 119(e) to U.S. provisional application Ser. No. 60/554,293, filed on Mar. 18, 2004.

FIELD OF THE INVENTION

This invention pertains generally to musical instruments and more particularly to transverse flute-type instruments of the woodwind family.

BACKGROUND OF THE FIELD

Transverse flutes and flute-type instruments, such as fifes and piccolos have been around for centuries. However, due to difficulties in sound production, these flutes present various problems for many people—including fingering and embouchure difficulties. The complex fingering on traditional flutes makes playing them problematic and even prohibitively so for the very young and other beginning players. A current alternative used in many elementary schools is the recorder (normally made of plastic with a built-in whistle mouthpiece), but recorders themselves present problems because they are blown vertically, presenting inferior handling to transverse instruments, and so do not afford a valuable introduction to traditional and orchestral flute-playing.

Various patented improvements have been made to recorder-type whistle flutes and other woodwind instruments in an effort to change the intonations and extend the ranges thereof. For instance, in U.S. Pat. No. 5,309,806 to Stavash, the device disclosed will change the intonation and pitch of a vertically-blown whistle flute by reducing the bore diameter. However, this device does not allow for any adjustment once inserted, and the instrument must still be blown vertically.

Likewise the devices disclosed in U.S. Pat. No. 4,515,060 to Ferron and U.S. Pat. No. 4,714,001 to Kergomard et al. reduce the bore sizes (at least in limited regions thereof) thereby changing the intonation of the instruments. However, these devices must be externally mounted on the instruments, and also the instruments must still be vertically blown.

SUMMARY OF THE INVENTION

The present invention solves the above-mentioned problems by providing a simple instrument that can be easily played and mastered by even young children and beginning players. The transverse whistle flute combines the blowing ease of the recorder as well as the well balanced handling of the traditional transverse flute. The transverse whistle flute also offers a greater usable range than a recorder, simpler fingering (in the six-hole pattern of the preferred embodiment), and elimination of the embouchure requirement of the traditional flute.

One embodiment of the invention comprises a cylindrical barrel—with a blowhole on the cylinder wall of one end and a series of finger holes towards the opposing end—and a whistle mechanism inserted into the barrel at the blowhole end (between the blowhole and the finger holes). With this design, a player, while holding the barrel of the whistle flute transversely to her body with the blowhole directly in front of her mouth, simply blows into the blowhole and fingers the finger holes, by alternately covering and uncovering them, according to the musical result desired. (The inventor has even composed a music book in tablature to assist the beginner.) The reflection of wind off the chamber walls before entering the narrow whistle passage is more similar to the effect made by a traditional embouchure than that of the end blown whistle.

Alternate embodiments may have the barrel reconfigured (elongated or narrowed) in order to afford a different key of music. The length of the barrel determines the pitch of the instrument, while the barrel diameter has the greatest effect on tone quality. Another embodiment comprises the whistle mechanism provided as an insert for converting traditional flutes to whistle flutes. The whistle mechanism may be used to build alternative mouthpieces or possibly as an insert to an existing mouthpiece.

DETAILED DESCRIPTION

Figure 1:
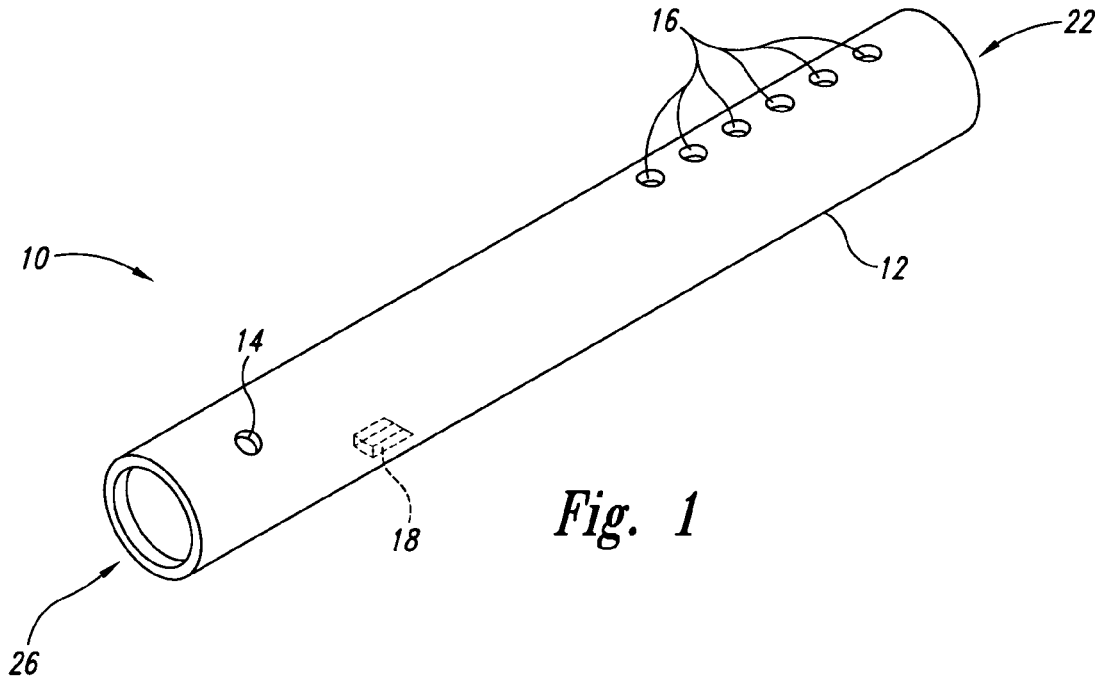
FIG. 1 is a perspective view of the preferred embodiment of the transverse whistle flute.

FIG. 1 shows the transverse whistle flute 10 according to the preferred embodiment as it is to be held and fingered by a player. The preferred embodiment comprises a generally cylindrical barrel 12, having generally uniform wall thickness, with a blowhole 14, a series of finger holes 16, and a generally rectangular sound hole 18.

Figure 2A:
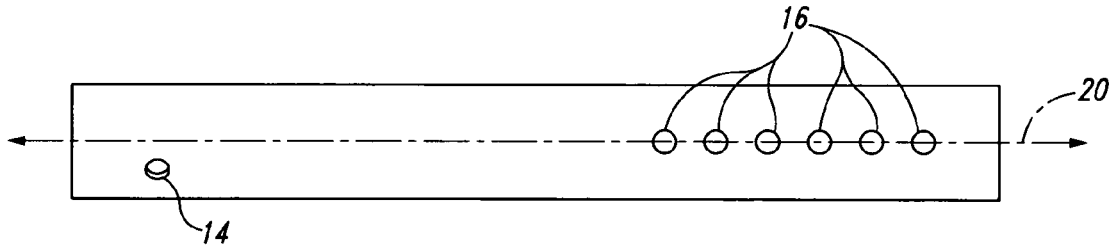
FIG. 2A is a top plan view of the preferred embodiment of the transverse whistle flute showing the orientation of blowhole to finger holes.
Figure 2B:
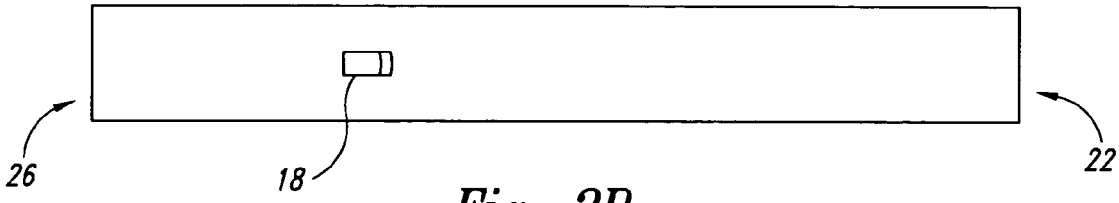
FIG. 2B is a bottom plan view of the preferred embodiment of the transverse whistle flute showing the sound hole.

FIGS. 2A and 2B together show the orientation of all of the holes (14, 16, and 18), which holes are bored through the barrel wall, and their relationships to one another. According to FIG. 2A, one can see that in the preferred embodiment, each of the finger holes 16 is located on the imaginary top reference line 20, which parallels the longitudinal axis of the barrel, and proximate the second end 22, and the blowhole 14 is located approximately 30° measured circumferentially from the top line 20 and proximate the first end 26. Obviously in alternate embodiments, the finger holes may be offset circumferentially from the top line or may be located and spaced longitudinally according to a different pattern. Also, in the preferred embodiment, the transverse whistle flute 10 measures 14.25" in overall length. Although the length could obviously vary, such length is chosen in order to tune the transverse whistle flute to approximate the key of a traditional flute. In FIG. 2B, the sound hole 18, which is located approximately 180° circumferentially from the top reference line 20 and proximate the first end 26, measures 11.375" from the second open end 22. Once again, this arrangement is necessary only to approximate the key of a traditional flute but could vary according to different designs.

Figure 3A:
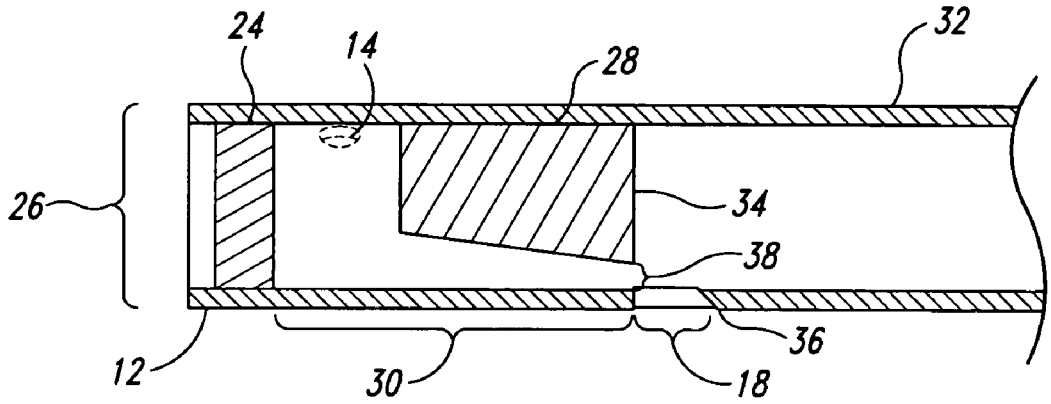
FIG. 3A is a detail side sectional view of the preferred embodiment of the whistle mechanism within the transverse whistle flute.

FIG. 3A shows a detail view of the whistle mechanism comprising plug and stopper. The generally round plug 24 is mounted within the barrel 12 adjacent the first open end 26 and fills the bore completely so as to seal the first barrel end. The plug must be located outward of the blowhole. The tapered stopper 28 is centered on the top line 20 such that the endplane 34 is oriented generally orthogonally to the longitudinal axis of the barrel and is mounted within the barrel 12 inwardly of the plug 24 creating a whistle chamber 30 defined by the barrel wall 32, the plug 24, the stopper 28, and the blowhole 14. The tapered stopper 28 stops the blown air from traveling freely down the barrel by obstructing the passageway, and instead forces the blown air through the small opening 38 of the whistle chamber, towards the sound hole 18, and over the wedge 36 thereof.

Figure 3B:
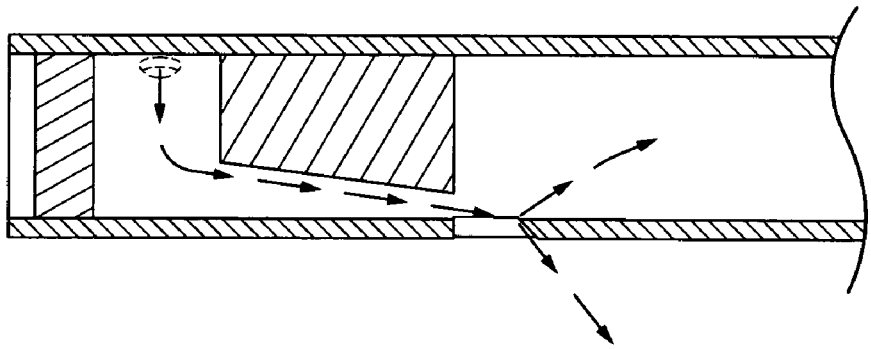
FIG. 3B is the same view of the whistle mechanism showing the blown air path.

It is important in the preferred embodiment that the generally rectangular sound hole 18 be located as shown, i.e., coincidentally in line with the endplane 34 of the stopper 28 such that the generally 45° wedge 36 of the sound hole 18 is oriented as shown towards the first end 26 of the barrel 12. In alternate embodiments, of course, these arrangements can be modified per design. (The wedge can also be made at an angle of other than 45°; however, the wedge must be as close to 45° as possible for optimum sound quality.) The arrows of FIG. 3B indicate the path of blown air blown by the player (not shown) into the blowhole 14, through the whistle chamber 30 of the barrel 12, and over the wedge 36 of the sound hole 18 down the barrel 12 toward the finger holes 16 and the second open end 22.

Figure 4:
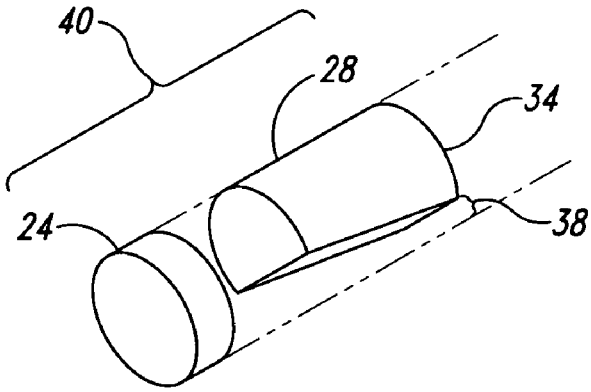
FIG. 4 is an exploded view of the whistle mechanism insert.

FIG. 4 shows a whistle mechanism insert 40 that can be installed in any traditional transverse flute having a generally cylindrical open-ended barrel having a longitudinal axis, with blowhole and finger holes, in order to convert it to a whistle flute. The plug is installed at the proximate end outward of the blowhole to seal the barrel, and the tapered stopper is installed inward of the blowhole with its endplane coinciding with the sound hole to define the whistle chamber. (The sound hole will need to be punched into the barrel as traditional flutes do not have such sound holes.) The requirement of the embouchure is thereby eliminated, and air is blown directly into the blowhole. The blown air is then directed past the tapered stopper (through the small opening), over the wedge of the sound hole and down the barrel past the series of finger holes towards the distal end of the barrel. Due to the difficulty of modifying a flute barrel directly, the whistle mechanism may be installed in an alternative mouthpiece for a traditional flute. Also alternate embodiments may have the barrel reconfigured (elongated or narrowed) in order to afford a different key of music.

What is claimed is:

1. A transverse whistle flute comprising:

a generally cylindrical barrel with a first open end, a second open end, and a generally uniform wall thickness, such barrel defining an imaginary top reference line along the length of the barrel and a series of finger holes arranged through the barrel wall along the top reference line of the barrel and located proximate said second end coincidentally with said top reference line, a blowhole through the wall proximate the first end and offset approximately 30 degrees circumferentially from said top reference line, and a generally rectangular sound hole through the wall proximate the first end inward of said blowhole and defining a wedge in the barrel wall located approximately 180 degrees circumferentially from said top reference line; and a whistle mechanism retained within the barrel proximate the first end comprising a whistle chamber surrounding said blowhole, including a plug sealing the first end of the barrel located outwardly of said blowhole and a tapered stopper also retained within the barrel and located inwardly of said blowhole, said stopper serving the purpose of stopping the blown air from traveling freely down the barrel by obstructing the barrel and pressurizing the air and directing the air through a small fixed opening and over the sound hole.

2. The transverse whistle flute of claim 1 wherein the sound hole is located inward of said blowhole and said whistle chamber and is located approximately 180 degrees circumferentially from the top reference line and approximately 150 degrees circumferentially from said blowhole.

3. The transverse whistle flute of claim 2 wherein the sound hole defines a wedge in the barrel wall positioned coincident with an endplane of the tapered stopper.

4. The transverse whistle flute of claim 3 wherein the wedge of the sound hole measures approximately 45 degrees and is oriented towards the first end of the barrel.

5. The transverse whistle flute of claim 3 wherein the plug is generally round, completely seals the first open end of the barrel, and is located outward of the blowhole.

6. The transverse whistle flute of claim 5 wherein the tapered stopper is located within the barrel inward of the plug and the blowhole and the whistle chamber, serves to direct blown air from the whistle chamber longitudinally down the barrel while pressurizing the air and through a small opening defined by the endplane of the stopper oriented generally orthogonally to the longitudinal axis and which coincides with the location of the sound hole through the barrel.

7. The transverse whistle flute of claim 6 wherein the barrel measures approximately 14.25 inches in length from the first end to the second end and the sound hole locates 11.375 inches from the second end.

8. The transverse whistle flute of claim 6 wherein the plug, the stopper, and the barrel wall together define a whistle chamber surrounding said blowhole that replaces a player's embouchure such that air blown through said blowhole will angle off the barrel wall and be directed over the wedge of the sound hole end thence down the barrel of the flute towards the second end.

9. In a traditional transverse flute having a blowhole adjacent the proximate end of the generally cylindrical open-ended barrel, said barrel having a longitudinal reference axis, and a series of finger holes proximate the distal end of the barrel, the improvement of a whistle mechanism comprising:

A generally round plug positioned outward of the blowhole to seal the proximate end of the barrel and a tapered stopper spaced inwardly of the blowhole so as to define a Whistle chamber around the blowhole that replaces a player's embouchure such that air blown through said blowhole will angle off the barrel wall and be directed by said tapered stopper through a small opening and down the barrel, said stopper also defining an endplane; and A generally rectangular sound hole located inward of said whistle chamber and said blowhole and located approximately 180 degrees circumferentially from the finger holes and adjacent the endplane of the stopper, and said blowhole is located approximately 30 degrees circumferentially from the finger holes and appproximately 150 decrees circumferentially from said sound hole.

10. The improvement of claim 9 wherein the endplane of the stopper is oriented generally orthogonally to the longitudinal axis of the barrel and defines said small opening through which air is directed over the pound hole said endplane being located inward of said whistle chamber.

11. The improvement of claim 10 wherein the plug seals the proximate end completely, and the plug is oriented generally orthogonally to the longitudinal axis of the barrel.

12. The improvement of claim 11 wherein the sound hole coincides with the endplane of the stopper and the sound hole defines a wedge oriented towards the proximate end of the barrel.

13. The improvement of claim 11 wherein the wedge of the sound hole measures approximately 45 degrees.

14. A method of a player playing a transverse whistle flute, said whistle flute having a generally cylindrical barrel with a blowhole through the barrel wall, a series of finger holes and a sound hole with a wedge, said whistle flute also having a whistle chamber within the barrel and surrounding the blowhole including a tapered stopper for directing blown air towards the finger holes, said method comprising the steps of:

the player holding the barrel of the whistle flute transversely to the player's body with the blowhole directly in front of the player's mouth and the player's fingers positioned to alternately cover and uncover the finger holes;

the player positioning the player's mouth without an embouchure in front of said blowhole and blowing directly into the blowhole so that the blown air travels through the whistle chamber making an approximately right angle turn and over the wedge of the sound hole; and the player fingering the finger holes of the barrel to alternately cover or uncover the various finger holes.

15. The method of claim 14 wherein the whistle chamber is defined by a plug and a tapered stopper positioned within the barrel on opposing sides of the blowhole such that air blown through the blowhole is directed through the whistle chamber, through a small opening, over the wedge, and down the barrel toward the finger holes.

16. The method of claim 15 wherein the blowhole is located approximately 30 degrees circumferentially from the finger holes and the generally rectangular sound hole is located approximately 180 degrees circumferentially from the finger holes.

17. The method of claim 16 wherein the tapered stopper defines an endplane and said small opening and the sound hole of the barrel is located to coincide with the endplane of the stopper.

18. The method of claim 15 wherein the wedge of the sound hole measures approximately 45 degrees.

19. The method of claim 14 wherein the player positioning said player's mouth comprises the player pressing the player's mouth without an embouchure directly against said barrel in order to blow directly into said blowhole.

* * * * *